US006513166B1

(12) United States Patent
Landis

(10) Patent No.: US 6,513,166 B1
(45) **Date of Patent: *Feb. 4, 2003**

(54) GOLF GLOVE

(76) Inventor: George Landis, 6261 Whispering Meadows, Canfield, OH (US) 44406

( * ) Notice: Subject to any disclaimer, the term of this patent is extended or adjusted under 35 U.S.C. 154(b) by 0 days.

This patent is subject to a terminal disclaimer.

(21) Appl. No.: 10/020,238

(22) Filed: Dec. 18, 2001

Related U.S. Application Data

(63) Continuation-in-part of application No. 09/704,886, filed on Nov. 2, 2000, now Pat. No. 6,363,535.

(51) Int. Cl.[7] ..... A41D 19/00
(52) U.S. Cl. ..... 2/161.4; 2/163; 2/205
(58) Field of Search ..... 2/161.1, 161.2, 2/161.3, 161.4, 163; 473/205

(56) References Cited

U.S. PATENT DOCUMENTS

| | | | | |
|---|---|---|---|---|
| 2,465,136 A | | 3/1949 | Troccoli | |
| 3,278,944 A | | 10/1966 | Gowers | |
| 3,532,344 A | | 10/1970 | Masstab | |
| 3,848,874 A | | 11/1974 | Elkins, Jr. | |
| 3,997,922 A | | 12/1976 | Huhta | |
| 4,590,625 A | | 5/1986 | Keim | |
| 4,665,565 A | | 5/1987 | Odom | |
| 4,691,387 A | | 9/1987 | Lopez | |
| 5,028,050 A | | 7/1991 | Freyer | |
| 5,218,719 A | | 6/1993 | Johnson | |
| 5,232,225 A | | 8/1993 | Snyder | |
| 5,542,126 A | | 8/1996 | Harvanek | |
| 5,644,795 A | | 7/1997 | Landis et al. | |
| 5,742,942 A | * | 4/1998 | Sykes | 2/161.2 |
| 6,035,443 A | * | 3/2000 | Green | 2/161.2 |
| 6,212,687 B1 | * | 4/2001 | Kwon | 2/161.3 |

* cited by examiner

*Primary Examiner*—John J. Calvert
*Assistant Examiner*—Katherine Moran
(74) *Attorney, Agent, or Firm*—Harpman & Harpman

(57) ABSTRACT

A golf glove and method of using same wherein the glove has alignment and gripping inserts that provide golf club grip alignment for an improved grip. The inserts define a preferred golf club grip position by illustrating a club position within the user's hand on the glove. Additional insert markers define grip position attributes visually during use and glove interengagement position. The alignment and gripping inserts are of contrasting color to the glove's primary material to define a sure grip position system for the golfer assuring proper club hand placement.

8 Claims, 8 Drawing Sheets

GOLF GLOVE

This is a CIP of U.S. patent application Ser. No. 09/704,886, filed Nov. 2, 2000, now U.S. Pat. No. 6,363,535.

BACKGROUND OF THE INVENTION

1. Technical Field

This invention relates to sports gloves used in the art of golf aids, more specifically gloves used to enhance and improve the golfer's performance by assuring the proper grip on the golf club 2. Description of Prior Art Prior art gloves of this type have used a variety of different glove configurations to help achieve the proper grip on the golf club in the golfer's hands. The grip is a critical aspect of the game to achieve optimum performance. In order to maximize the golfer's grip on the club and to aid in the grip placement, a number of prior art patents have been cited, see for example U.S. Pat. Nos. 2,465,136, 3,278,944, 3,532,344, 3,848,874, 3,997,922, 4,590,625:4,665,565, 4,691,387, 5,028,050, 5,218,719, 5,232,225, 5,542,126, 5,511,246, 5,644,795.

In U.S. Pat. No. 2,465,136 a golfer's glove is described illustrating a number of sponge rubber or cellulose sponge inserts on the palm portion for gripping the club.

In U.S. Pat. No. 3,278,944 a means for assisting in the teaching of golf is disclosed wherein a golf glove has three continuous strips secured to the back of the glove, each strip being of a distinct color. By viewing the colored strips, the golfer's grip position can be analyzed before the club is swung.

U.S. Pat. No. 3,532,344 discloses a glove having a contact non-slip elements and grip areas on the fingertips and palm portion.

U.S. Pat. No. 3,848,874 is directed to a golf glove and system having indicia on the glove's back and thumb portions to present a visual guide and sight line along the thumb as the golf club is gripped which then identifies that a proper grip has been achieved.

Referring to U.S. Pat. Nos. 3,997,922, 4,590,625, 4,665,565 and 4,691,387, all disclose golf gloves having multiple gripping surfaces on the finger and palm portions in side-by-side transverse aligned relationship.

U.S. Pat. No. 5,028,050 is directed to a golfer's grip training device where portions of the gloves have fastening insert areas of corresponding hook and loop material on respective gloves for glove-to-glove inner engagement during the gripping process.

U.S. Pat. No. 5,232,225 defines a golf glove having gripping tape inserts that form a tenuous bond when engaged on the club.

U.S. Pat. No. 5,542,126 illustrates an instructional hand glove wherein proper grip guides are indicated on the glove surface.

U.S. Pat. No. 5,511,248 discloses an anti-slip glove having thermoplastic polyethylene film panels on the key pressure points.

Applicant's own prior U.S. Pat. No. 5,644,795 defines a golf glove and method of using same having a plurality of aligned inserts of contrasting material extending across the finger and palm portions with an extension portion along the palm.

SUMMARY OF THE INVENTION

An improvement on a single golf glove that helps position and maintains a correct grip on the golf club. The glove has tactual surface inserts that define a grip position across the glove fingers and extended palm portion for the golf club correct position. A separate club alignment indicator on the index finger completes the palm side club alignment. A plurality of grip determining markers on the backside of the glove across the knuckle area determine the proper rotational position of the hands in relation to the grip portion. A pair of independent contoured markers on the respective palm portion and adjacent thumb portion combine during the grip to indicate proper visual sight alignment for angular inclination of the grip relative to the user's body.

DESCRIPTION OF THE PREFERRED EMBODIMENT

Figure 1:
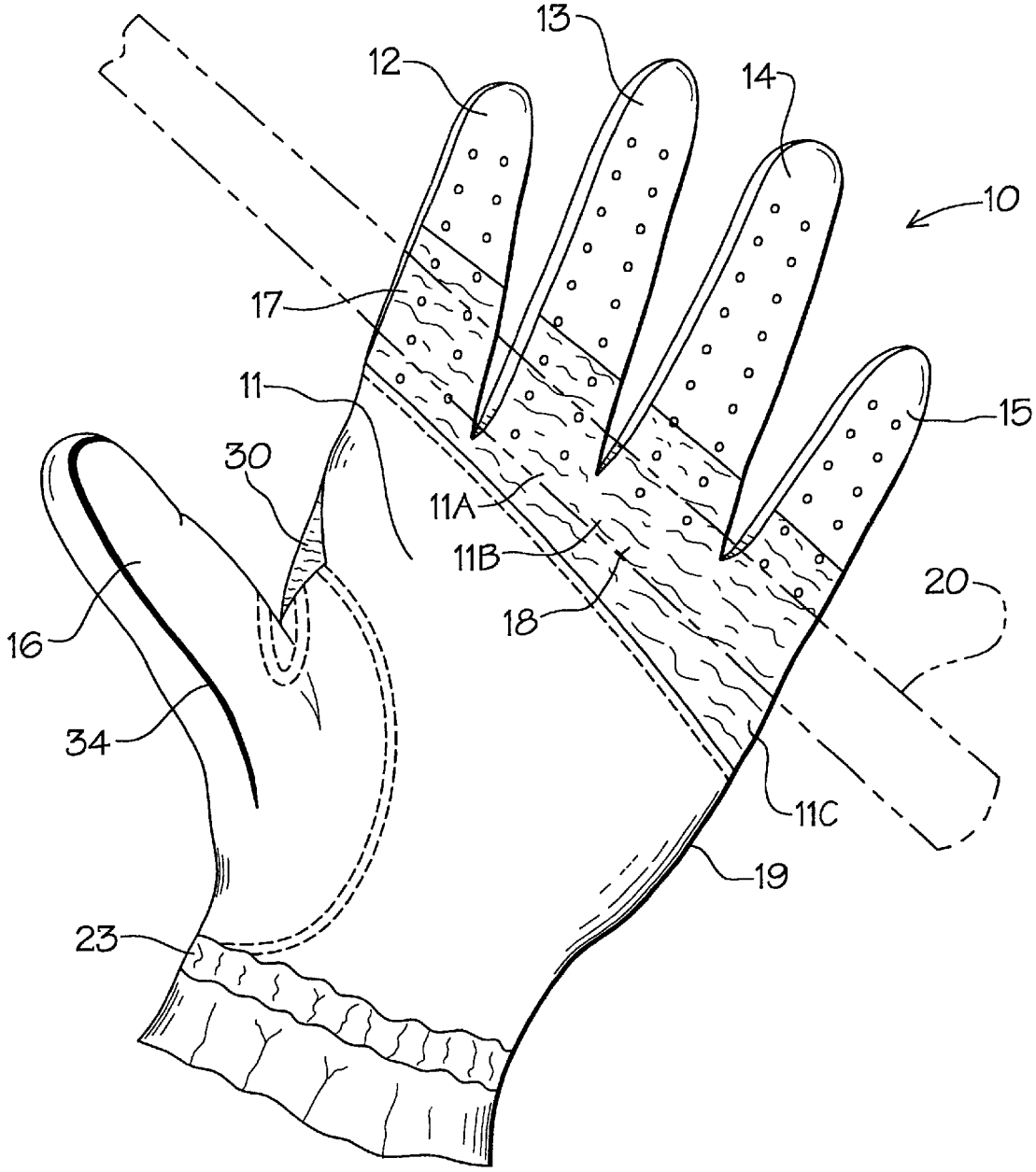
FIG. 1 is a perspective view of the palm portion of the improved golf glove having the club aligned inserts and a club indicated in broken lines positioned thereon.

Referring now to FIG. 1 of the drawings, a golf glove 10 can be seen having a palm portion 11, a plurality of finger portions 12–15 and a thumb portion 16 extending therefrom. The glove 10 has a pair of material inserts 17 and 18 that are positioned on the finger portion 12 and respective fingers 13, 14, and 15 and palm 11 respectively. As noted, the insert 18 extends transversely across the fingers 13, 14 and 15 in an aligned angular inclination to one another and extends beyond the respective fingers onto the palm portion 11 and progressively below the finger portions as illustrated at 11A, 11B and 11C. The inserts 17 and 18 are preferably made of synthetic material of a contrasting color and non-slip increased frictional co-efficient material in relation to the surrounding glove material which will be well known to those skilled in the art.

Figure 2:
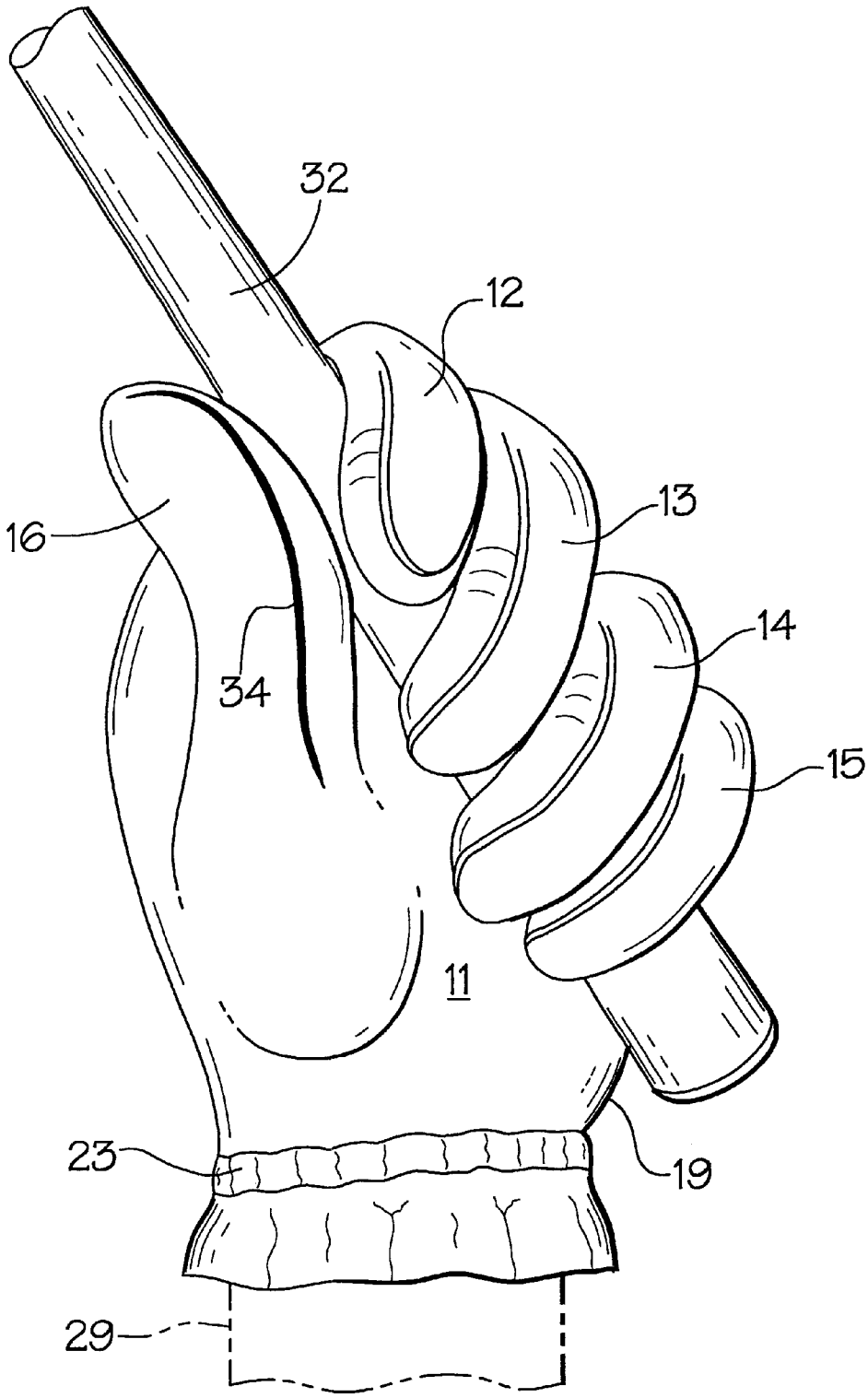
FIG. 2 is a perspective view of the improved golf glove shown in FIG. 1 engaged about a golf club defining an improved sure grip position therein.

A handle portion 20 of a golf club is shown in broken lines, as noted above, in the glove 10 overlying the finger insert 17 and the finger portions of the insert 18 so as to be in abutting overlapping position with the handle portion 20. It will be evident from the above description that a true preferred golf grip is achieved by the distinctive angular alignment over the hereinbefore described inserts 17 and 18 as seen in FIG. 2 of the drawings.

Figure 3:
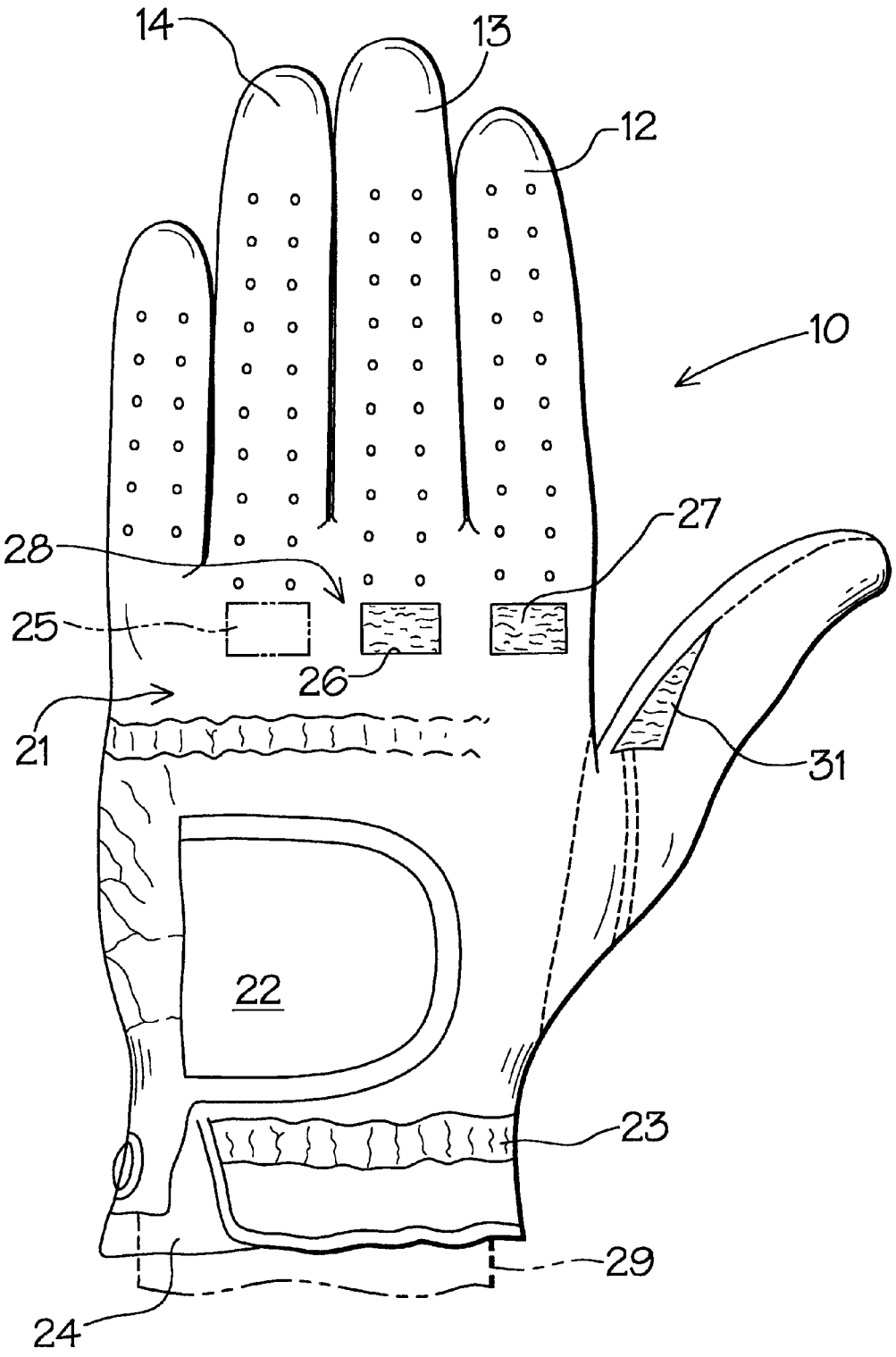
FIG. 3 is a perspective view of the back hand side of the glove illustrating visualization grip alignment markers thereon.
Figure 4:
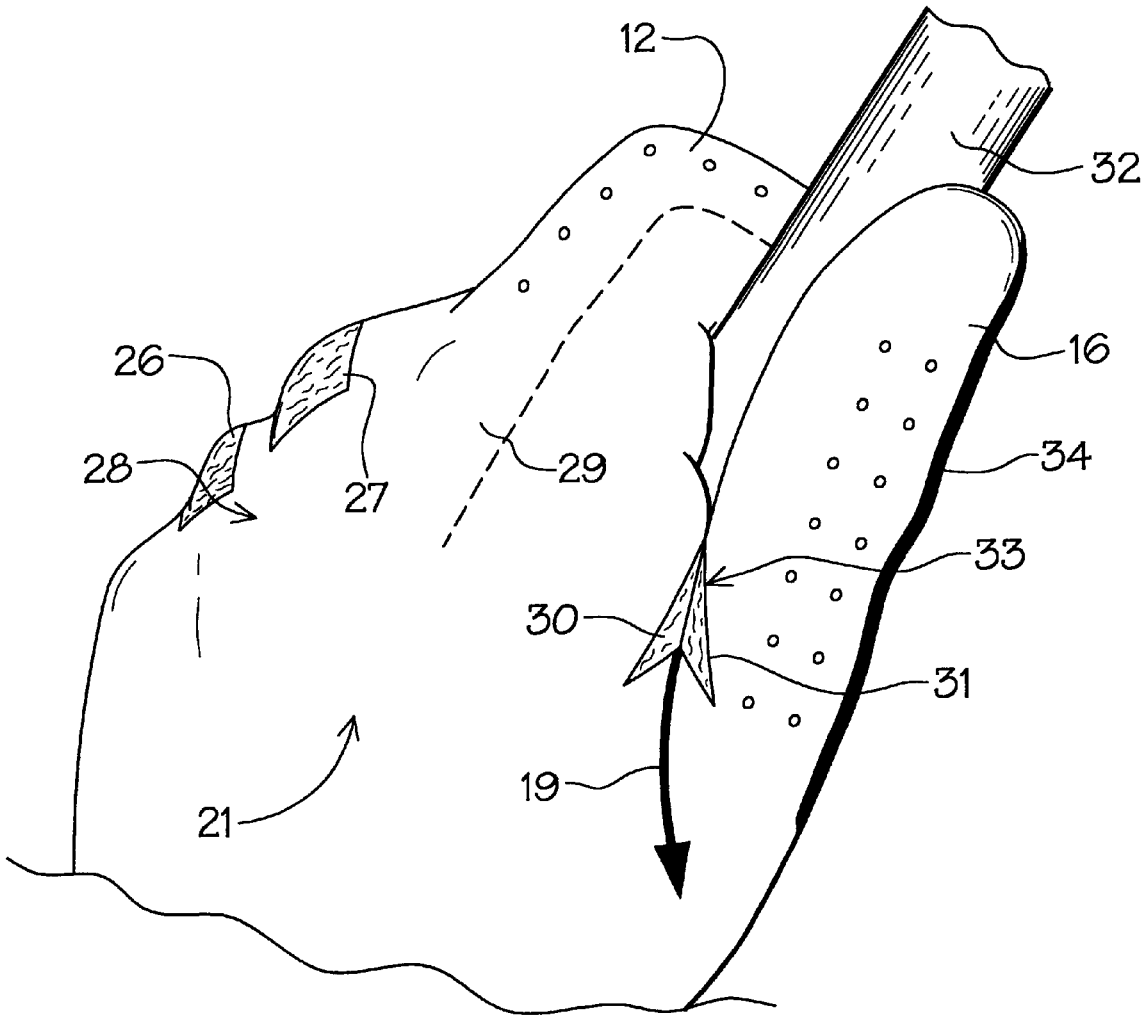
FIG. 4 is an enlarged partial perspective view of the index and thumb portion of the glove gripped around a club shaft indicating the correct position by the visualization markers.

Referring now to FIG. 3 of the drawings, the glove 10 of the invention is shown on its back hand portion 21. The glove 10 has an adjustable closing flap 22 and integral elastic band insert 23 inwardly of its open end at 24. A plurality of indicator markers 26 and 27 are positioned below the respective finger portions 12 and 13 in spaced relation to one another overlying a knuckle engagement area generally indicated at 28 of the glove 10. An indicator marker 25 shown in broken lines is a visual indicator for use with some golfers. The indicator markers 25, 26 and 27 are preferably of a rectangular configuration of a similar dimensional size. It will be seen that the markers 25, 26 and 27 form a transverse longitudinal alignment band in which portions of same are viewable dependent on the axial rotation of the glove by the golfer during the grip positioning process. Thus it will be seen that once the proper grip on the golf club is achieved, as seen in FIG. 4 of the drawings, that the visualization of the markers 26 and 27 will indicate the relative "strength" i.e. nature of the grip from the user's perspective. Specifically, if all of the markers are visible, the user has achieved a strong grip by effectively rotating of the hand. Conversely, if only the marker 27 is visible as seen in FIG. 4 of the drawings, then you have what is characterized as a "weak" grip.

Figure 5:
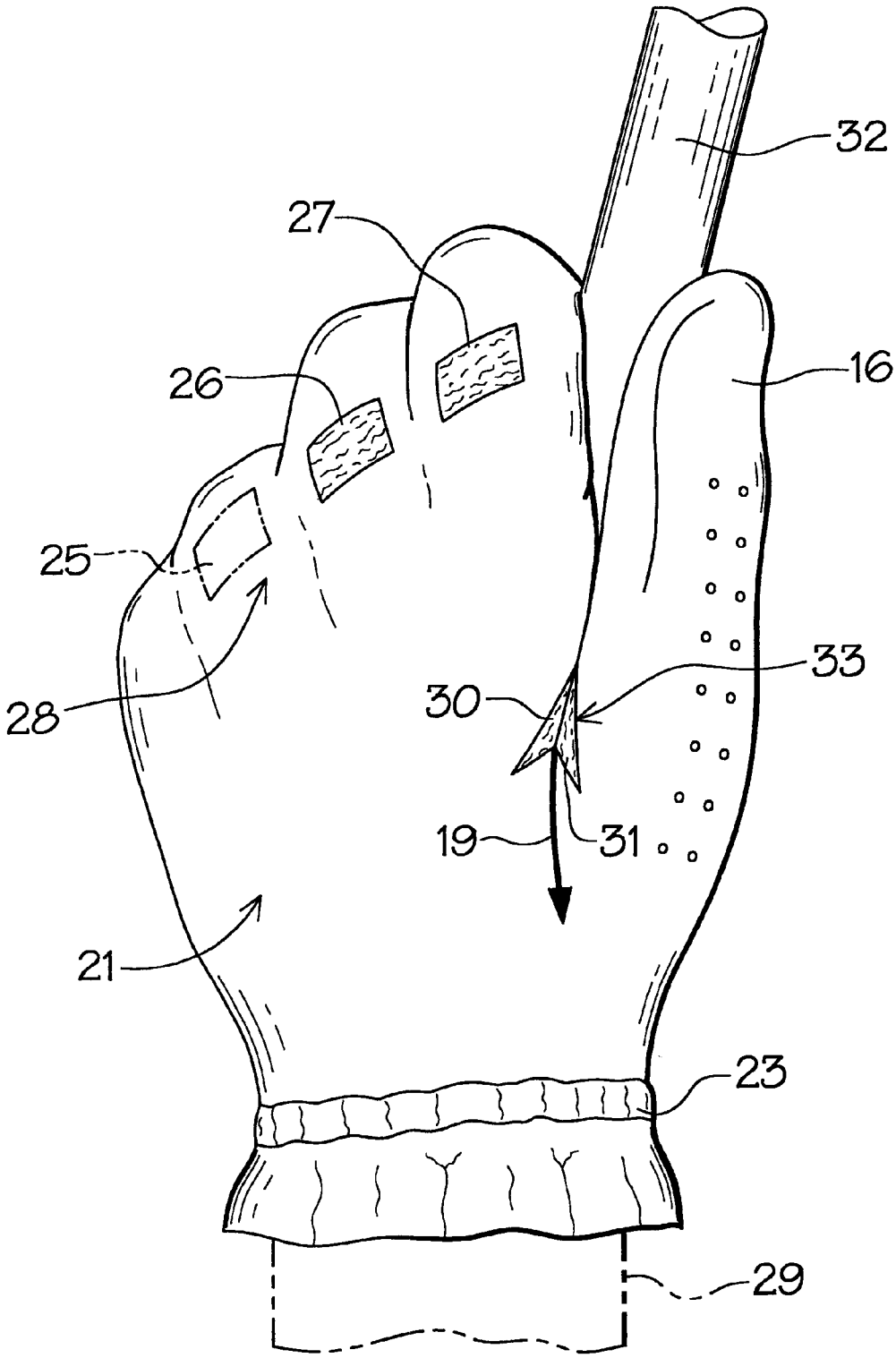
FIG. 5 is a perspective view of the back hand side of the improved golf glove gripping a club illustrating the hand rotation indicator markers thereon for grip position by visualization.

A pair of alignment angle markers 30 and 31 are positioned respectively on the base of the thumb portion 16, as best seen in FIG. 3 of the drawings, and on the side of the palm portion 11 below the finger portion 12 as best seen in FIG. 1 of the drawings. An arrow indicator 19 extends from the junction of the markers 30 and 31. Each of the respective markers 30 and 31 are shaped as a portion of a triangular arrow so that when brought together as when gripping the club 32 define a visual alignment arrow indicator 33 that with the indicator arrow 19 ideally should point towards the right eye of a right handed user and to the left eye on a left handed glove user (not shown), as best seen in FIGS. 4 and 5 of the drawings in which the user's hand 29 is illustrated in broken lines within the glove 10.

The inserts 17 and 18 are preferably secured to the glove's perspective finger and palm portions by replacing selective glove material in the defined areas by sewing or similar fabric adjoining techniques common to glove construction.

Referring to FIGS. 1, 2 and 4 of the drawings, an inter-grip glove interengagement line marker 34 can be seen extending along the seam line of the thumb portion 16 so as to provide an inter-glove positional relationship wherein the glove's position to the user's non-gloved hand (not shown) is indicated by alignment with an anatomical palm fold "life line" well known to those skilled in the art.

Alternately, the defined areas 17,18 and hereinbefore described markers 25, 26, 27,30, 31, 34 and 19 can be imprinted on the surface of the glove in a contrasting color to that of the glove using conventional fabric printing techniques as are well known and understood by those skilled in the art. Additionally, the fabric printing can impart a different textured surface which will define an increased frictional grip surfaces.

Figure 6:
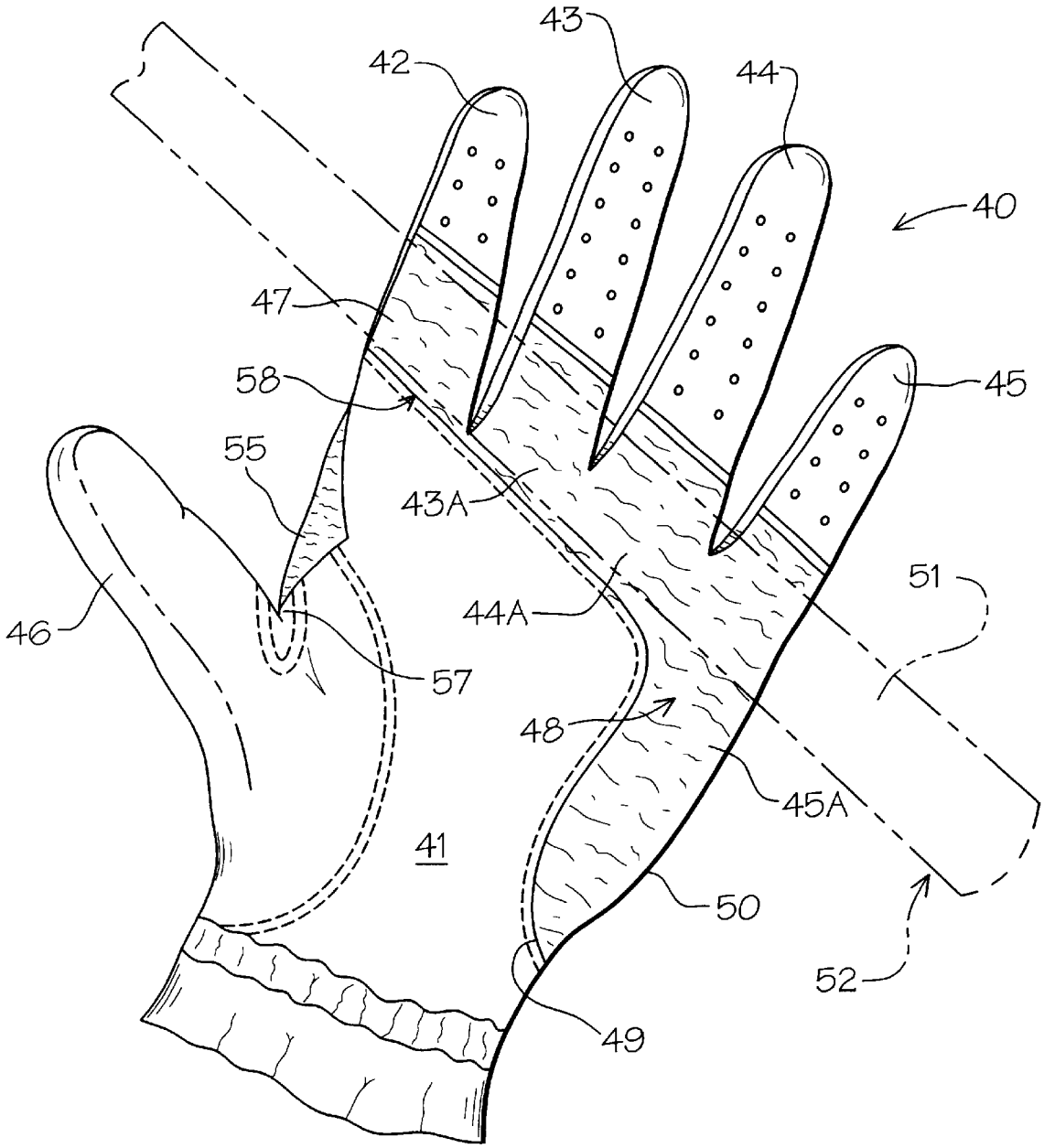
FIG. 6 is a perspective view of the palm portion of an alternate form of the invention.

Referring now to FIG. 6 of the drawings, an alternate golf glove 40 can be seen having a palm portion 41, a plurality of finger portions 42–45 and a thumb portion 46 extending therefrom. The glove 41 has a pair of material inserts 47 and 48 that are positioned on the finger portion 42 and respective fingers 43, 44, and 45 and the palm 41 respectively. As noted, the insert 48 extends transversely across the fingers 43, 44, and 45 in an aligned angular inclination to one another and extends beyond the respective fingers onto the palm portion 41 and progressively below the finger portions as illustrated at 43A, 44B and 45A which extend substantially onto the palm portion 41 at 49 along the glove seams 50. The inserts 47 and 48 are preferably made of synthetic material of a contrasting color in relation to the surrounding glove material.

A handle portion 51 of a golf club 52 is shown in broken lines overlying the finger insert 47 and the finger portion of the insert 48 so as to be in abutting overlapped position with the handle portion 51. It will be evident from the above description that a true preferred golf grip is achieved by the distinctive angular alignment over the hereinbefore-described inserts 47 and 48.

Figure 7:
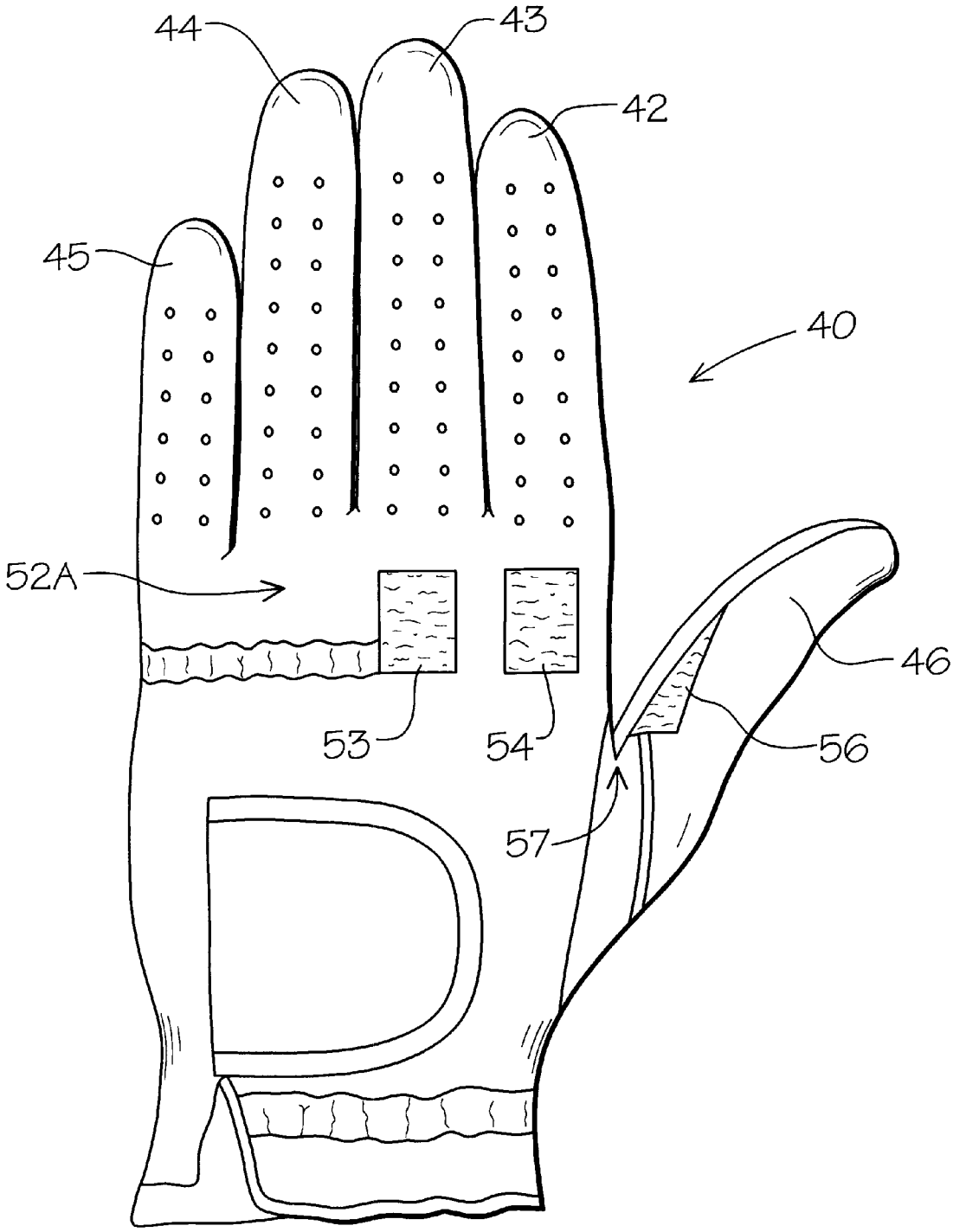
FIG. 7 is a perspective view of the back hand side of the glove illustrated in FIG. 6.
Figure 8:
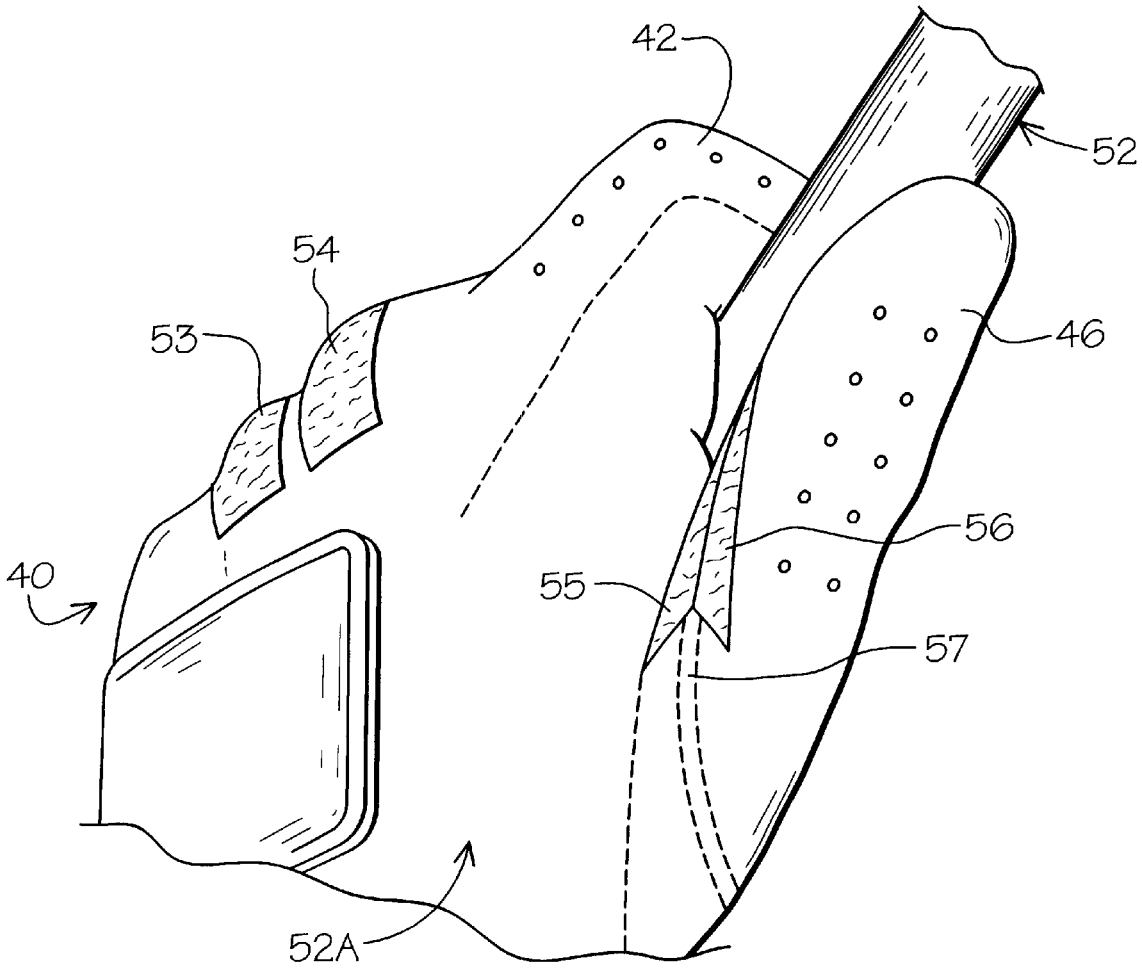
FIG. 8 is an enlarged partial perspective view of the index and thumb portion of the alternate glove gripping around a club shaft.

Referring now to FIGS. 7 & 8 of the drawings, the alternate glove 40 is shown on its backhand portion 52. The alternate glove 40 has a pair of indicator markers 53 and 54 that are positioned below the respective finger portions 42 and 43 in spaced relation to one another overlying a knuckle engagement area generally indicated at 55.

The indicator markers 53 and 54 are preferably of a rectangular configuration of similar dimensional size.

A pair of alignment angle markers 55 and 56 are positioned respectively on the base of the thumb portion 46 as best seen in FIG. 7 of the drawings and on one size of the palm portion 11 extending from the base of the thumb portion 46 at 57 to the base of the finger portion at 58. Each of the respective markers 55 and 56 are shaped as a portion of a triangular arrow and are of dissimilar dimensions so that when brought together as when gripping the club 52 will define an enlarged visual alignment arrow indicator which ideally should point towards the right eye of a right handed user and to the left eye of a left handed user, (not shown) as best seen in FIG. 8 of the drawings.

It will thus be seen that an improved version of a golf glove has been illustrated and described and it will be apparent to those skilled in the art that various changes and modifications may be made therein without departing from the spirit of the invention.

Therefore I claim:

1. A golf glove comprises in combination, a golf glove having a palm portion, a plurality of finger portions and a thumb portion, an integral elastic band extending around the base of the glove beyond the thumb portion, gripping and alignment surfaces located on the palm portion of said glove, a first gripping and alignment surface extending transversely and angularly across the palm side of one of said finger portions, a second gripping and alignment surface extending transversely and angularly across the palm portion side of the remaining finger portions, a portion of said second gripping and alignment surface extending from said finger portions onto said palm portion to said elastic band, a pair of longitudinally spaced gripping markers extending over a knuckle engagement area of said glove in spaced relation to said finger portions, a grip alignment indicator on said thumb portion registerable with a corresponding grip alignment indicator on said palm portion adjacent said thumb portion.

2. The golf glove set forth in claim 1 wherein said gripping and alignment surfaces are of a contrasting color to that of said surrounding glove surface.

3. The golf glove of claim 1 wherein said gripping markers are of equal size.

4. The golf glove set forth in claim 1 wherein said grip alignment indicators are of an unequal dimension and define together a directional alignment indicator during use between the thumb portion and adjacent finger portion.

5. The golf glove set forth in claim 1 wherein said grip alignment indicator on said palm portion is of a known dimension extending from the first gripping and alignment surface to the base of said thumb portion and said grip alignment indicator on said thumb portion is of an overall dimension less that that of said grip alignment indicator on said palm portion.

6. The golf glove set forth in claim 1 further comprises, imprinting said gripping markings and said grip alignment indicators on the corresponding glove's surfaces with a contrasting color to that of said surrounding area.

7. The golf glove set forth in claim 1 wherein said gripping and alignment surfaces are of a natural textured material having a different frictional co-efficient than that of said surrounding area.

8. The golf glove set forth in claim 5 wherein imprinting said gripping markings and said grip alignment indicators with a contrasting color imparts a different frictional co-efficient than that of said non-imprinted areas.

* * * * *